United States Patent [19]

La Voie

[11] Patent Number: 4,606,281

[45] Date of Patent: Aug. 19, 1986

[54] THIEF-TRAPPING APPARATUS

[76] Inventor: Louis T. La Voie, 201 W. Huron St., Buffalo, N.Y. 14201

[21] Appl. No.: 615,033

[22] Filed: May 29, 1984

[51] Int. Cl.[4] ..... E05G 3/00

[52] U.S. Cl. ..... 109/3; 109/39; 109/50; 70/422

[58] Field of Search ..... 109/3, 6, 7, 38, 39, 109/44, 32, 20, 21, 50, 52; 70/1.5, 76, 281, 422; 43/59, 61, 67; 292/141, 144, 201; 248/551

[56] References Cited

U.S. PATENT DOCUMENTS

| | | | |
|---|---|---|---|
| 1,611,787 | 12/1926 | Snavely | 109/3 |
| 2,507,328 | 5/1950 | Ashley | 292/141 |
| 2,643,372 | 6/1953 | Stelter | 109/21 |
| 3,113,395 | 12/1963 | Van Kuren | 43/61 |
| 4,118,902 | 10/1978 | Saxton | 248/551 |
| 4,180,287 | 12/1979 | Youngblood et al. | 292/144 |

FOREIGN PATENT DOCUMENTS

| | | | |
|---|---|---|---|
| 385530 | 12/1932 | United Kingdom | 292/141 |

*Primary Examiner*—Thomas J. Holko
*Assistant Examiner*—Neill Wilson
*Attorney, Agent, or Firm*—Christel, Bean & Linihan

[57] ABSTRACT

A thief-trapping apparatus for a room having a closure permitting room ingress and egress and an object therein to be safeguarded utilizes a locking mechanism for the room closure and a cord having a frangible link. The locking mechanism includes a bolt and a bolt receptacle which are operatively mountable on the closure and the wall of the room adjacent the closure. When operatively mounted on the room wall and closure, the bolt is movable between a first position at which the bolt cooperates with the bolt receptacle to lock the closure in a closed condition and a second position at which the closure is unlocked. The locking mechanism further includes a spring for biasing the bolt from its second position to its first position, and the cord is fastened at one end to the bolt so that when the cord is pulled from its other end, the bolt moves to its second position. The other end of the cord is fastenable to the room object to be safeguarded so that if, after the other cord end is fastened to the room object so as to hold the bolt in its second position, the bolt is disconnected from the object by the occurrence of an event, such as the breaking of the frangible link in the cord, the bolt is moved by the spring to its first, or closure-locking, position.

15 Claims, 4 Drawing Figures

Fig. 1.
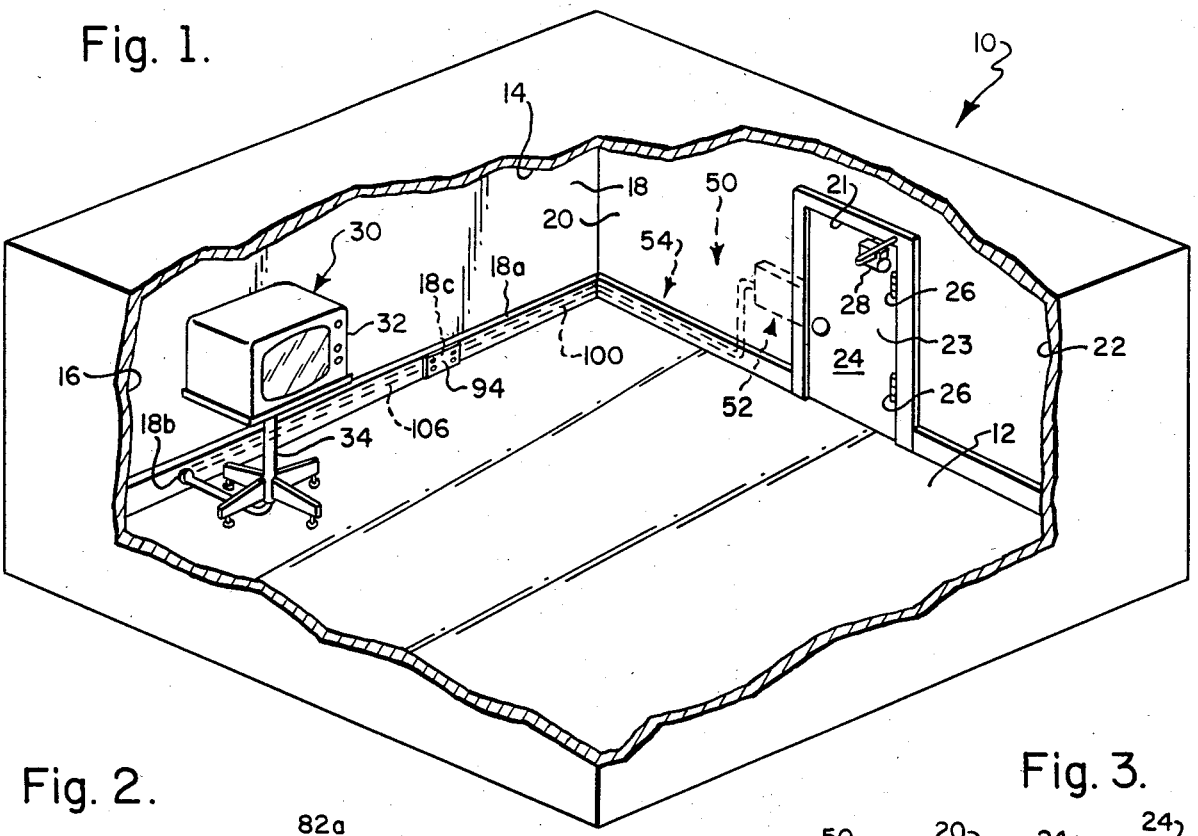
Fig. 2.
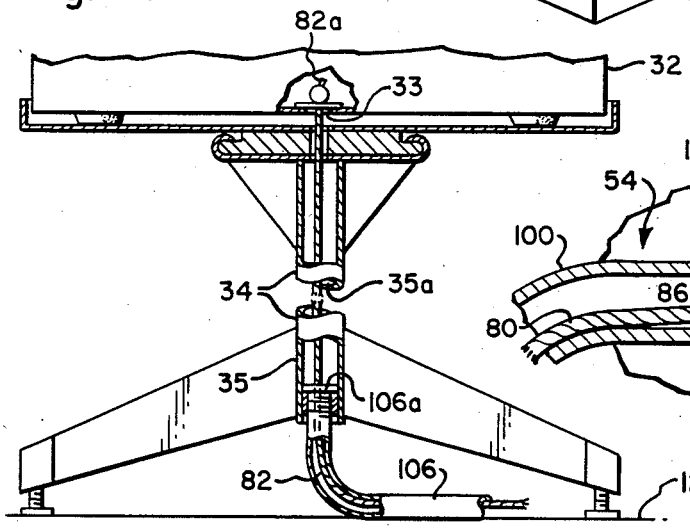
Fig. 3.
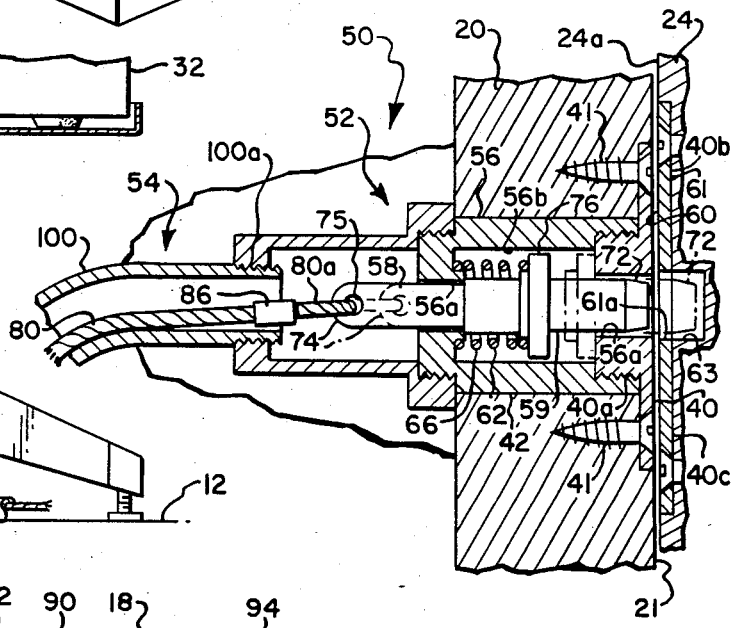
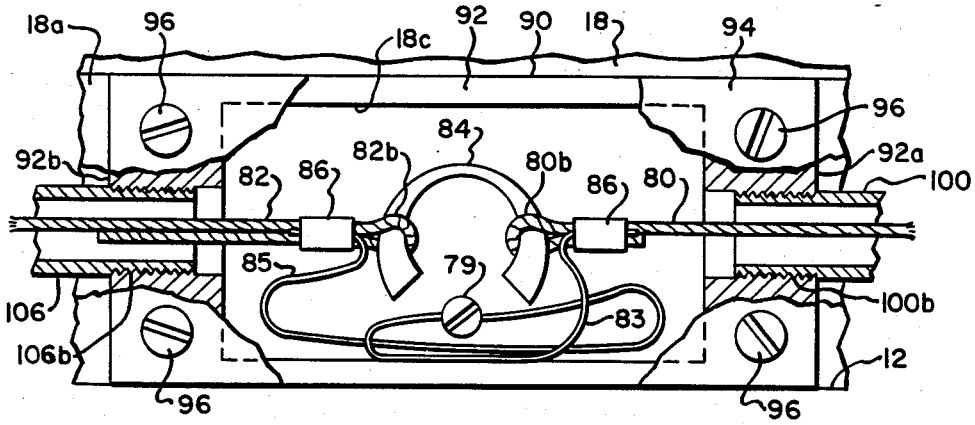
Fig. 4.

THIEF-TRAPPING APPARATUS

BACKGROUND OF THE INVENTION

This invention relates in general to protective systems and deals more particularly to thief-trapping apparatus for trapping a thief in a room.

Thief-trapping apparatus for trapping a thief within the confines of a room during the course of a theft are known. Commonly, such an apparatus includes a mechanism or means for locking the room doors or windows so as to cut off possible avenues of escape from the room. Such an apparatus is shown and described in U.S. Pat. No. 1,852,642.

It is an object of the present invention to provide a new and improved thief-trapping apparatus for trapping a thief within the confines of a room during the course of a theft.

Another object of the present invention is to provide such an apparatus which, when used to lock the room doors or windows, provides tangible evidence of an attempted theft.

Still another object of the present invention is to provide such an apparatus which is well-suited for safeguarding a single object in a room.

A further object of the present invention is to provide such an apparatus which is uncomplicated in structure yet effective in operation.

SUMMARY OF THE INVENTION

This invention resides in a thief-trapping apparatus for a room having an object therein to be safeguarded, a wall, and an opening in the wall permitting room ingress and egress, and a closure for the opening being movable between a first condition at which the room opening is closed and a second condition at which the room opening is open.

The thief-trapping apparatus is comprised of a locking mechanism for the room closure and cord means. The locking mechanism includes a bolt receptacle and a bolt, one of the bolt receptacle and the bolt being mountable on the closure and the other being mountable on the room wall for operative association one with the other. When the bolt and bolt receptacle are operatively mounted on the wall and closure, the bolt is movable between a first position at which it cooperates with the receptacle to lock the closure in its closed condition and a second position at which the closure is unlocked. The locking mechanism also includes biasing means for biasing the bolt from its second position to its first position. The bolt of the locking mechansim is connectable to the room object to be safeguarded through the cord means. The cord means has two opposite ends and one of its ends is fastened to the bolt so that when the cord means is pulled from its other end, the bolt moves to its second position. The other end of the cord means is connectable to the room object to be safeguarded so that if, after said other end of the cord means is connected to the room object so as to hold the bolt in its second position, the bolt is disconnected from the object, the bolt is moved by the biasing means to its first position.

The apparatus is set when its bolt and bolt receptacle are operatively mounted on the closure and wall and the cord means is connected to the room object so that the bolt is held in its second, or door-unlocking position. In order for a thief to steal the object, the bolt must be disconnected therefrom. However, the instant the bolt is disconnected from the object, the bolt locks the closure so that the thief and the object to be protected are secured within the confines of the room.

An advantage provided by the apparatus of this invention is that the disconnected bolt is tangible evidence which can be used in an effort to convict the thief of attempting to steal the object. Another advantage of the apparatus of the present invention relates to its operative association with a single object in the room. More specifically, the apparatus is connectable to a single object so that in an attempt to steal the object, its closure-locking mechanism is actuated. It follows, then, that the apparatus is well-suited for safeguarding a single object in a room.

BRIEF DESCRIPTION OF THE DRAWINGS

FIG. 1 is a perspective view of a room, shown partially cut-away, in which an embodiment of an apparatus in accordance with the present invention is utilized.

FIG. 2 is a fragmentary elevation view of the rear of the FIG. 1 television set and stand, shown partially cut-away, and a portion of the FIG. 1 embodiment.

FIG. 3 is a longitudinal cross-sectional view, shown in elevation, of another portion of the FIG. 1 embodiment and room.

FIG. 4 is a fragmentary elevation view, shown partially cut-away of still another portion of the FIG. 1 embodiment and room.

DETAILED DESCRIPTION OF AN ILLUSTRATIVE EMBODIMENT

Turning now to the drawings in greater detail, there is shown in FIG. 1 a room, generally indicated 10, having a floor 12, a ceiling 14 and four walls 16,18,20 and 22. Included along the base of the wall 18 and on the side thereof facing inwardly of the room 10 is a baseboard 18*a*. Defined in baseboard 18*a* is a circular opening 18*b* and a rectangular opening 18*c* whose purpose will become apparent hereinafter. The room wall 20 has a door opening 21, and the room includes a closure, indicated 23 for the opening 21 in the form of a door 24 to permit room ingress and egress. The door 24 is hung in the opening 21 of the room wall 20 with hinges 26,26 so as to permit swinging movement of the door 24 relative to the wall 20 between a first condition, as shown, at which the door is closed and a second condition at which the door is open. The door 24 includes a door-closing actuator 28 mounted in a manner well known in the art for biasing the door 24 from its second, or open, condition to its first, or closed, condition.

The room 10 also includes an object, indicated 30, to be safeguarded. The object 30 is in the form of a television set 32 and, as shown in FIGS. 1 and 2, rests upon a stand 34. As shown in FIG. 2, the stand 34 includes a hollow support pedestal 35 defining a vertical opening 35*a* extending between the base of the television set 32 and a location near the room floor 12. Defined in the base of the television set 32 is an aperture 33 which aligns with the pedestal opening 35*a*.

Referring again to FIG. 1 and in accordance with the present invention, there is utilized in the room 10 an apparatus, generally indicated 50, for locking the door 24 in its closed condition in response to a predetermined event. As will be described in greater detail hereinafter, the apparatus 50 locks the door 24 during an attempt by a thief to steal the television set 32 while the thief is within the confines of the room 10.

With reference to FIGS. 1 and 3, the apparatus 50 includes a door-locking mechanism, indicated generally 52, and cord means, indicated generally 54. The door-locking mechanism 52 includes a housing 56, a locking bolt 58, a bolt-receiving receptacle 60 and a biasing means 62. The housing 56 includes a series of threadably-joined steel units 40,42,44 defining a through-opening 56*a* and a cavity 56*b* in communication with the opening 56*a*. The unit 40 includes an externally threaded portion 40*a* and two tab portions 40*b*, 40*c* which each define apertures for supportedly mounting the housing 56 in the room wall 20 with screws 41,41. The unit 42 has an internally threaded end for receiving the threaded portion 40*a* and an externally threaded end portion 42*a*. The unit 44 has two internally-threaded ends, one of which threadably accepts the threaded end portion 42*a* of the unit 42.

Referring still to FIG. 3, the locking bolt 58 is constructed of steel and has a shank 59 which is generally elongated in form. The opposite end portions of the bolt 58 are indicated 72 and 74. One end portion 74 of the bolt 58 defines a circular through-opening or hole 75, and the shank 59 defines an annular shoulder 76. The bolt 58 is slidably accepted by the through-opening 56*a* of the housing 56 with its shoulder 76 positioned within the housing cavity 56*b*. The bolt 58 is slidably movable relative to and along the housing through-opening 56*a* between a first position, shown in phantom, at which part of its end portion 72 protrudes outwardly of the housing 56 and a second position, as shown in solid lines, at which its end portion 72 is wholly retracted within the housing 56. The sliding movement of the bolt 58 is confined to movement generally along a line which is parallel to the plane of the room wall 20.

The bolt-receiving receptacle 60 includes a narrow steel plate 61 fixedly attached with screws along the edge, indicated 24*a*, of the door 24 so as to be positioned, when the door 24 is closed, adjacent the housing 56. The plate 61 defines a through-slot 61*a* within which the bolt end portion 72 can be slidably received.

The receptacle 60 further includes a groove 63 formed in the door edge 24*a*. The groove 63 aligns with the plate slot 61*a* so as to accept part of the bolt end portion 72 when the bolt 58 is positioned in its first, or phantom, position.

As shown in FIG. 3, the housing 56 is mounted within the room wall 20 adjacent the door opening 21 so that when the door 24 is closed, the housing 56 is positioned adjacent the receptacle 60. It will be understood that the housing 56 and receptacle 60 are so operatively positioned relative to one another that when the bolt 58 is in its first position, its end portion 72 is accepted by the receptacle 60 and when the bolt 58 is in its second position, its end portion 72 is positioned out of the receptacle 60. It will also be understood that when the bolt 58 is in its aforedescribed first position, the door 24 is in a locked condition, and when the bolt 58 is in its aforedescribed second position, the door 24 can be opened.

The biasing means 62 of the door-locking mechanism 52 includes a compression spring 66 for biasing the bolt 58 from its second, or door-unlocking, position toward its first, or door-locking, position. One end of the spring 66 is fixedly attached, as by welding, to the shoulder 76 of the bolt 58 and the other end of the spring 66 is fixedly attached, as by welding, to one wall of the housing cavity 56*b*. Thus, the spring 66 acts between the housing 56 or wall 20 and the bolt 58 to bias the bolt 58 from its second, or solid line, position toward its first, or phantom, position.

When the bolt 58 is in its first position and as shown in FIG. 3, the spring 66 is not fully compressed. The bolt 58 can therefore be moved from its first position further within the housing 56, or to the left as shown, until the spring 66 is fully compressed. When the spring 66 is fully compressed, the bolt 58 can move no further within the housing 56.

With reference to FIGS. 2, 3 and 4, the cord means 54 of the apparatus 50 is comprised of two lengths 80 and 82 of cord and a replaceable breakable link 84 joining the cord lengths 80 and 82. Each cord length 80 or 82 is comprised of a thin steel wire, but any suitable material having a relatively high tensile strength and a relatively high degree of flexibility, such as rope, can be used. The breakable link 84 is in the shape of an inverted U and is constructed of a suitable material, such as frangible plastic, designed to break in two when a nominal force, such as a ten pound force, is applied to the legs of the U in order to pull the legs apart. As will be set forth in detail hereinafter, the link 84 is designed to break when an attempt is made to steal the television set 32.

As shown in FIG. 4, the breakable link 84 is positioned in a link housing 90 having a cup-shaped body 92 and a rectangular cover 94 for covering the interior of the body 92. The housing body is mounted in the room wall 18 and so arranged therein that its cup opens inwardly of the room 10 and is accessible through the rectangular opening 18*b* in the baseboard 18*a*. The body 92 has two opposite ends which define internally threaded openings 92*a* and 92*b*, and further defines four threaded apertures for threadably accepting the shanks of screws 96,96. The rectangular cover 94 is plate-like and defines four through-holes which align with the defined apertures of the housing body 92. The through-holes of the cover 94 loosely accept the shanks of the screws 96,96 so that the cover is releasably held between the housing body 92 and the heads of the screws 96,96. Thus, the cover 92 can be removed if replacement of the breakable link 84 is necessary.

The cord length 80 is positioned within and its movement is guided along the length of a bendable conduit 100. The conduit 100, in turn, extends along a portion of the length of the room wall 20 and the room wall 18. One end, indicated 100*a*, of the conduit 100 is threadably received within the unit 44 of the housing 56 and the other conduit end, indicated 100*b*, is threadably received within the threaded end 92*a* of the body 92 of the link housing 90. As shown in FIGS. 1 and 3, the bends of the conduit 100 provide rounded corners around which the cord length 80 is easily permitted to move when the cord length 80 is pulled from either of its ends. The cord length 80 has an end portion 80*a* which is fastened to an end portion 74 of the locking bolt 58. More specifically, the cord length end portion 80*a* is looped through the hole 75 in the bolt 58 and attached upon itself with a connector 86. The cord length 80 further has an end portion 80*b* which is fastened to one leg of the breakable link 84, as shown in FIG. 4. More specifically, the cord length end portion 80*b* is looped about a corresponding leg of the breakable link 84 and is attached upon itself with a connector 86. Fastened between the connector 86 attached about the end portion 80*b* and a screw, indicated 79, in the housing body 92 is a length of string 83 whose purpose will be hereinafter apparent.

The other cord length 82 is positioned within and its movement is guided along the length of a bendable conduit 106. The conduit 106, in turn, extends along a portion of the length of the room wall 20 and across the floor 12. One end of the conduit, indicated 106*a*, is threadably received within the lower end of the stand support pedestal 35 and the other end of the conduit, indicated 106*b*, is threadably received within the threaded end 92*b* of the body 92 of the link housing 90. As are those of the conduit 100, the bends in the conduit 106 are rounded so as to provide rounded corners around which the cord length 82 is easily permitted to move when the cord length 82 is pulled from either of its ends.

The cord length 82 has an end portion 82*a* which is fastened to the television set 32. More specifically, the cord end portion 82*a* extends through the aperture 33 in the base of the television set 32 and is tied to a stop device within the set 32 so that its end portion 82*a* is prevented from passing out of the set 32 through the aperture 33. The cord length 82 further has an end portion 82*b* which is fastened to one length of the breakable link 84, as shown in FIGS. 4. More specifically, the cord length end portion 82*b* is looped about a corresponding leg of the breakable link 84 and is attached upon itself with a connector 86. Fastened between the connector 86 attached about the end portion 82*b* and the screw 79 in the housing body 92 is a length of string 85 whose purpose will be hereinafter apparent.

The cord means 54, when fully intact and connected between the set 32 and the bolt 58 as aforedescribed, holds the bolt 58 against the force of the spring 66. When the bolt 58 is disconnected from the set 32 at the occurrence of an event, such as the breaking of the link 84 of the cord means 54, the spring 66 moves the bolt 58 from its second position to its first position.

The apparatus 50 is set for operation when, with reference to FIGS. 2–4, the cord means 54 is so connected between the television set set 32 and the bolt 58 so that the bolt 58 is held in its second position. A thief who intends to steal the television set 32 must initially enter the room 10 through the door 24 which, by means of the actuator 28, closes behind him. Then, in order for the thief to remove the set 32 from the room 10, the set 32 must be lifted off the stand 34. As the set 32 is lifted, however, the cord means 54 draws the bolt 58 within the housing 56, or moves the bolt 58 to the left as shown in FIG. 3, until the spring 66 is fully compressed. At this point, the cord length 80 is anchored at its end portion 80 so that further lifting of the set 32 pulls the breakable link 24 in two and thereby disconnects the set 32 from the bolt 54. Of course, when the bolt 54 is disconnected from the set 32, the spring 86 moves the bolt 70 to its first, or door-locking position, so that the avenue of escape from the room 10 by way of the door 24 is cut off.

It will be understood that the cooperation between the locking mechanism 52 and spring 66 which permits the bolt 58 to be drawn within the housing 56 beyond the aforesaid second position of the bolt 58 permits the set 32 to be lifted a short distance before a separating stress is applied to the breakable link 84. Insofar as it is much easier for a thief to break the breakable link 84 once the set 32 is in motion than it is for the thief to simultaneously break the link 84 and place the set 32 in motion, this permitted short distance of movement is advantageous.

Since the apparatus 50 immediately locks the door 24 when the bolt 54 is disconnected from the television set 32, the set 32 is secured within the room 50 with the thief. Thus, the apparatus 50 is advantageous in that it can be used to trap the thief in the room 10 and to prevent removal of the set 32 from the room 10. Another advantage provided by the apparatus 50 is that the breakable link 84, when in its broken condition, provides tangible evidence which can be used in an effort to convict the thief of his attempted theft.

Because the strings 83 and 85 are attached to the end portions 80*b* and 82*b* of the cord lengths 80 and 82, respectively, each cord length is prevented from traveling very far from the link housing 90 and along its corresponding conduit 100 or 106. Thus, to reset the apparatus 50, the set 32 is repositioned upon the stand 34 and cord end portions 80*b* and 82*b* are pulled together, by means of the strings 83 and 85, within the body 92 of the link housing 90 and rejoined with a replacement link like that of breakable link 84 of FIG. 4. When, of course, the cord length 80 is pulled from its end portion 80*b*, the bolt 58 moves from its first, or door-locking position, toward its second position.

It will be understood that numerous modifications and substitutions can be had without departing from the spirit of the invention. For example, although the bolt 58 and bolt-receiving receptacle 60 have been described as mounted upon the room wall 20 and door 24, respectively, the bolt 58 and receptacle 60 can be mounted on the door 24 and wall 20, respectively, in accordance with this invention. Furthermore, although the apparatus 50 has been described above as utilized with a room door 24, the apparatus 50 can also be utilized with another room closure, such as a window. Accordingly, the present invention has been described in an illustrative embodiment by way of illustration rather than limitation.

I claim:

1. A thief-trapping apparatus for a room having an object within to be safeguarded, a room wall, an opening in the wall permitting room ingress and egress, and a closure for the opening being movable between a first condition at which the room opening is closed and a second condition at which the room opening is open, said apparatus comprising:

a locking mechanism for the room closure including (a) means defining a bolt receptacle, (b) a bolt for cooperating with said receptacle means, one of said bolt and said receptacle means being operatively mountable on said closure and the other being operatively mountable on the room wall so that when said bolt and said receptacle means are operatively mounted on the room wall and closure, said bolt is movable between a first position at which said bolt cooperates with said receptacle means to lock the closure in its closed condition and a second position at which the closure is unlocked, and (c) means for biasing said bolt from its said second position to its said first position; and cord means through which said bolt is connectable to the room object to be safeguarded and having two opposite ends and a frangible link connected between said ends, one of said ends being fastened to said bolt so that when said cord means is pulled from its other end, said bolt moves to its said second position, said other end of said cord means being connectable to the room object to be safeguarded so that if, after said other end of said cord means is pulled and connected to the room object so as to hold said bolt in its said second position, said bolt is disconnected from the object, said bolt is moved by said biasing means to its said first position, said frangible link being of sufficient strength to hold said opposite ends of said cord means together when said cord means is connected so as to hold said bolt in said second position and adapted to break when said two opposite ends are pulled beyond a predetermined level of force so that when the object to be safeguarded is pulled in opposition to said one cord end beyond said predetermined level of force, said bolt is disconnected from the object by the breaking of said frangible link.

2. An apparatus as defined in claim 1 wherein said biasing means is a spring which acts between the room wall and said bolt.

3. An apparatus as defined in claim 2 wherein said spring is a compression spring.

4. An apparatus as defined in claim 1 wherein said bolt is mountable upon one of the room wall and closure for sliding movement between its said first and second positions.

5. An apparatus as defined in claim 4 wherein said bolt includes an elongated shank, the receptacle of said receptacle means is of such size and shape to receive a portion of said elongated shank, and said shank portion moves along a substantially linear path into and out of said receptacle when said bolt is moved between its said first and second positions.

6. An apparatus as defined in claim 1 wherein said locking mechanism further includes a housing adapted for mounting upon one of the room wall and closure, said housing includes a body defining cavity means extending within said body from an exterior surface of said body, and said bolt and biasing means are mounted within said cavity means.

7. An apparatus as defined in claim 1 wherein said receptacle means includes a flat plate defining a through-slot of such shape and size to accept said portion of said bolt shank when said bolt is in its said first position.

8. An apparatus as defined in claim 1 wherein said cord means includes a cord length of thin steel wire.

9. An apparatus as defined in claim 1 wherein said cord means further includes a first cord length and a second cord length, one end of said first cord length being fastened to said bolt and one end of said second cord length being connectable to the room object, the other ends of said first and second cord lengths being joined to said frangible link.

10. An apparatus as defined in claim 9 wherein said frangible link is in the shape of a U and each of the other ends of said first and second cord lengths is fastened to a corresponding leg of the U.

11. An apparatus as defined in claim 1 wherein said bolt and said biasing means cooperate in such a manner as to permit the object to be protected to be moved a short distance before said frangible link is stressed to its breaking limit so that said link is apt to be stressed as aforesaid when the object is in motion and said link can thereby be broken with relative ease.

12. A thief trap comprising in combination:

a room having an object within to be safeguarded, a wall, an opening in the wall permitting room ingress and egress, and a closure for said opening being movable between a first condition at which said room opening is closed and a second condition at which said room opening is open;

a locking mechanism including means defining a bolt receptacle, a bolt for cooperating with said receptacle means, one of said bolt and said receptacle means being mounted on said closure and the other being mounted on said room wall, said bolt being movable between a first position at which said bolt cooperates with said receptacle means to lock said closure in its closed condition and a second position at which said closure is unlocked, and means for biasing said bolt from its said second position to its said first position; and cord means having two opposite ends and a frangible link positioned between said two opposite ends and being connected between said bolt and the room object to be safeguarded so that said bolt is held in its said second position and against the biasing force of said biasing means so that if said bolt is disconnected from the object, said bolt is moved by said biasing means to its said first position said frangible link being of sufficient strength to hold together when said cord means is connected so as to hold said bolt in said second position and adapted to break when said two opposite ends are pulled beyond a predetermined level of force so that when the object to be safeguarded is pulled in opposition to said one cord end beyond said predetermined level of force, said bolt is disconnected from the object by the breaking of said frangible link.

13. A trap as defined in claim 12 wherein said bolt is mounted on said wall and said bolt receptacle is mounted on said closure.

14. A trap as defined in claim 12 wherein said bolt and said biasing means cooperate in such a manner as to permit the object to be protected to be moved a short distance before said frangible link is stressed to its breaking limit so that said link is apt to be stressed as aforesaid when the object is in motion and said link can thereby be broken with relative ease.

15. A thief-trapping apparatus for a room having an object within to be safeguarded, a room wall, an opening in the wall permitting room ingress and egress, and a closure for the opening being movable between a first condition at which the room opening is closed and a second condition at which the room opening is open, said apparatus comprising:

a locking mechanism for the room closure including (a) means defining a bolt receptacle, (b) a bolt for cooperating with said receptacle means, one of said bolt and said receptacle means being operatively mountable on said closure and the other being operatively mountable on the room wall so that when said bolt and said receptacle means are operatively mounted on the room wall and closure, said bolt is movable between a first position at which said bolt cooperates with said receptacle means to lock the closure in its closed condition and a second position at which the closure is unlocked, and (c) means for biasing said bolt from its said second position to its said first position; and cord means through which said bolt is connectable to the room object to be safeguarded and having two opposite ends, one of said ends being fastened to said bolt so that when said cord means is pulled from its other end, said bolt moves to its said second position, said other end of said cord means being connectable to the room object to be safeguarded so that if, after said other end of said cord means is connected to the room object so as to hold said bolt in its said second positions, said bolt is disconnected from the object, said bolt is moved by said biasing means to its said first position, said cords means includes a first cord length, a second cord length, and a frangible link, one end of said first cord length being fastened to said bolt and one end of said second cord length being connectable to the room object, said frangible link being in the shape of a U and each of the other ends of said first and second cord lengths being fastened to a corresponding leg of the U and said frangible link adapted to break and thereby disconnect said bolt from the object when the object is attempted to removed from the room.

* * * * *